US006848864B1

(12) United States Patent
Davie, Jr. et al.

(10) Patent No.: US 6,848,864 B1
(45) Date of Patent: Feb. 1, 2005

(54) INTERLOCKING SLAB LEVELING SYSTEM

(75) Inventors: Warren P. Davie, Jr., Kenner, LA (US); James A. Gillen, Metairie, LA (US)

(73) Assignee: Warren Davie, Kenner, LA (US)

( * ) Notice: Subject to any disclaimer, the term of this patent is extended or adjusted under 35 U.S.C. 154(b) by 0 days.

(21) Appl. No.: 10/011,678

(22) Filed: Dec. 4, 2001

Related U.S. Application Data

(60) Provisional application No. 60/277,573, filed on Mar. 21, 2001.

(51) Int. Cl.[7] ..... E02D 27/48; E02D 5/30; E02D 7/02

(52) U.S. Cl. ..... 405/230; 405/251; 405/252

(58) Field of Search ..... 405/230, 231, 405/232, 251, 252

(56) References Cited

U.S. PATENT DOCUMENTS

| | | | | |
|---|---|---|---|---|
| 2,065,507 A | * | 12/1936 | Alexander | 405/252 |
| 2,187,677 A | * | 1/1940 | Brumley | 405/251 X |
| 2,351,288 A | * | 6/1944 | Riches | 405/252 |
| 3,382,680 A | | 5/1968 | Takano | |
| 3,593,532 A | | 7/1971 | Grazel | |
| 3,625,012 A | | 12/1971 | Thorburn | |
| 3,748,863 A | | 7/1973 | Pogonowski et al. | |
| 3,884,589 A | | 5/1975 | Liedholm | |
| 4,157,230 A | | 6/1979 | Tomt et al. | |
| 4,604,003 A | | 8/1986 | Francoeur et al. | |
| 4,605,340 A | | 8/1986 | Stephan | |
| 4,627,769 A | | 12/1986 | Lee | |
| 4,668,119 A | * | 5/1987 | Galletti | 405/251 X |
| 4,735,527 A | | 4/1988 | Bullivant | |
| 4,836,717 A | | 6/1989 | Landaeus et al. | |
| 5,096,333 A | | 3/1992 | Bassett | |
| 5,288,175 A | | 2/1994 | Knight | |
| 5,320,453 A | | 6/1994 | Bullivant | |
| 5,399,055 A | | 3/1995 | Dutton, Jr. | |
| 5,505,561 A | | 4/1996 | Wilcox, III | |
| 5,531,544 A | | 7/1996 | Wilcox, II | |
| 5,713,701 A | | 2/1998 | Marshall | |
| 6,200,070 B1 | * | 3/2001 | Knight | 405/232 |

FOREIGN PATENT DOCUMENTS

| | | | | |
|---|---|---|---|---|
| GB | 2280466 | * | 2/1995 | 405/231 X |
| JP | 62-194320 | * | 8/1987 | 405/232 X |
| JP | 62-273318 | * | 11/1987 | 405/252 X |
| JP | 6-73991 | * | 3/1994 | 405/251 X |

OTHER PUBLICATIONS

Printout from web page of Meadow Burk for "Coil Hanger Saddle" and "Adjustable Screed Chairs", Mar. 16, 2001.

* cited by examiner

*Primary Examiner*—Sunil Singh
(74) *Attorney, Agent, or Firm*—Garvey, Smith, Nehrbass & Doody, L.L.C.; Brett A. North

(57) ABSTRACT

A method and apparatus for repairing building foundations by segmented underpinning. More specifically, a method and apparatus is provided for repairing building foundations using interlocking segmented underpinning piles which are reinforced in a longitudinal direction.

18 Claims, 8 Drawing Sheets

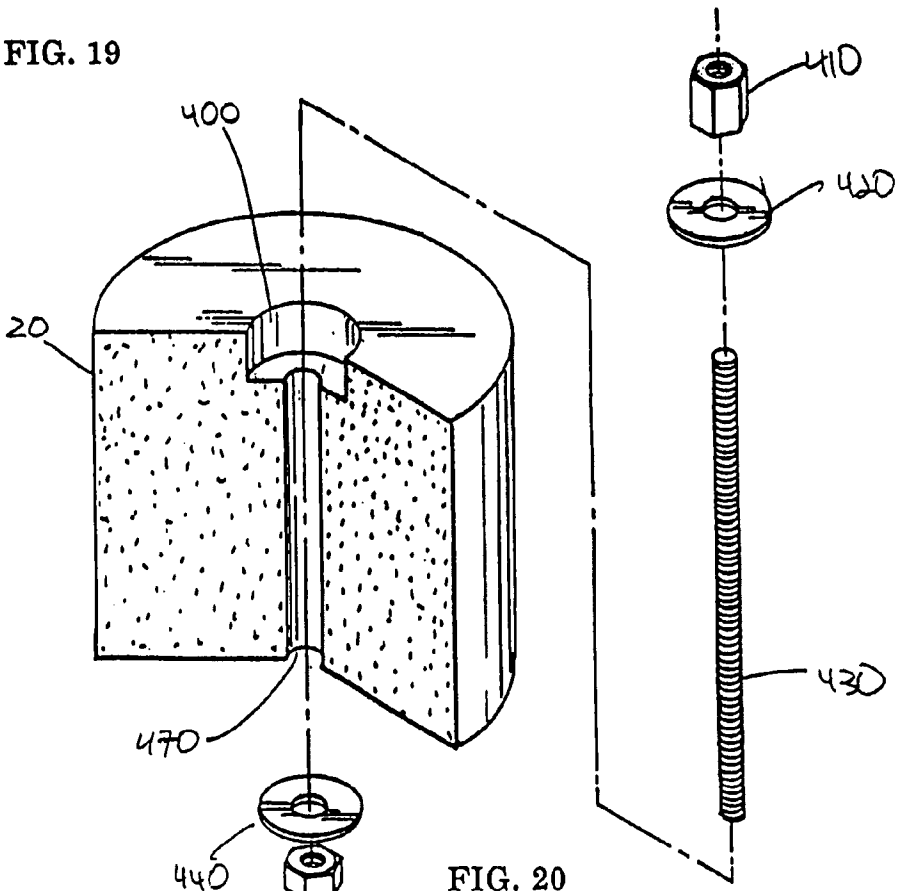
FIG. 19
FIG. 20
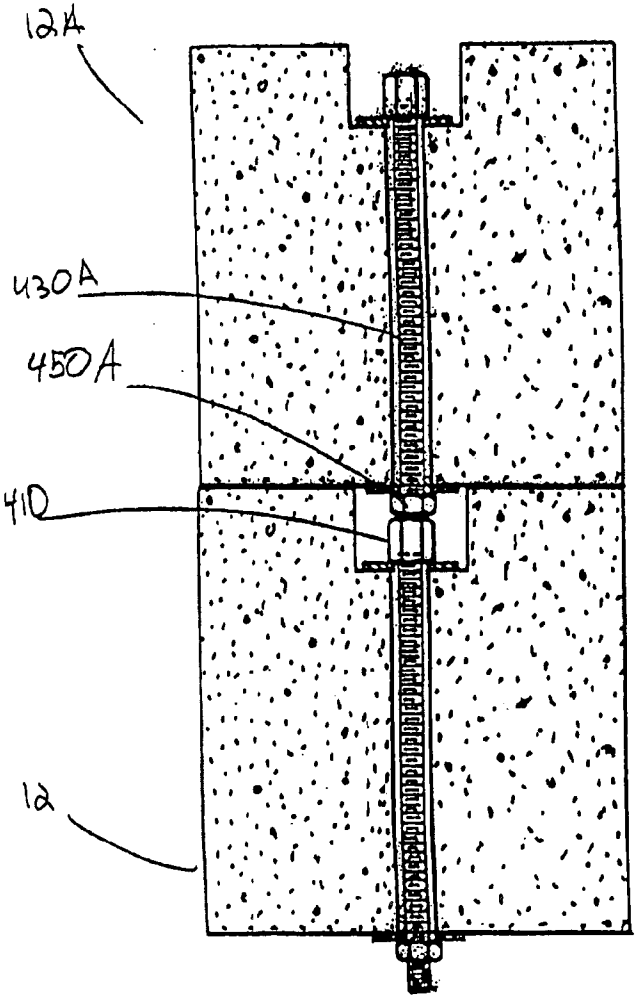

INTERLOCKING SLAB LEVELING SYSTEM

CROSS-REFERENCE TO RELATED APPLICATIONS

Priority of U.S. Provisional Patent Application Ser. No. 60/277,573, filed 21 Mar. 2001, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the repair of building foundations by underpinning. More specifically, the present invention relates to an interlocking slab leveling system using longitudinally reinforced segmented underpinning pilings.

2. General Background of the Invention

Most conventionally available leveling systems use segmented underpinning pilings comprised of vertically stacked, unconnected, precast concrete segments. These segments are pressed or driven vertically into the soil one at a time until an adequate load capacity is obtained. Segmented underpinning pilings are useful because they can be installed with minimal clearance underneath an existing foundation which is to be leveled.

Although serviceable, these segmented underpinning pilings have various disadvantages, which include, but are not limited to: (a) pile segments being not aligned, other than being stacked one on top of each other allowing for problematic misalignments and (b) completed underpinning pilings being unreinforced stacks of precast concrete segments. Misalignment of segments during installation can produce several problematic conditions related to pile stability.

Non-interlocked segmented underpinning pilings can separate at segment joints or fail at segment midpoints where dynamic soil conditions create transient longitudinal or tensile stresses, such as in clay soils having high shrink-swell potentials. Separation of segments can occur when clay soils swell after an increase in moisture content where the soil swell exposes the segmented pile to tension forces in a longitudinal direction.

These transient longitudinal stresses are detrimental to non-interlocked segmented underpinning pilings because they can create gaps between the piling segments. Even a slight gap between two segments allows for soil intrusion between the two segments and prevents closing of the gap when soil moisture decreases. Each time a new swell cycle is found the gap can be increased allowing for additional soil intrusion. Each joint between the various segments can experience this phenomenon. Over a period of years, cyclical shrink-swell effect can lift the upper portion of the segmented underpinning pile and the supported structure creating a new non-leveled condition.

A second type of segmented piling system is described in U.S. Pat. No. 5,288,175 which describes a segmental precast concrete underpinning pile using a continuous high strength strand for longitudinally reinforcing the various the precast segments which strand is bonded or anchored upon completion. This type of piling is more labor intensive to install then the present invention in requiring monitoring of the placement of the individual segments, threading of the strand, and placement of the bonding agent. Areas with high water tables can circumvent the use of a bonding agent as the water comes in contact with the agent. Furthermore, the steel strand can relax over time reducing the amount of longitudinal reinforcement. Additionally, if the strand fails due to corrosion or for some other reason the entire pile becomes an unreinforced segmented pile with the above described disadvantages.

The following U.S. patents are incorporated herein by reference: U.S. Pat. No. 5,288,175.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY OF THE INVENTION

The apparatus of the present invention solves the problems confronted in the art in a simple and straightforward manner. What is provided is a method and apparatus for repairing building foundations by segmented underpinning. More specifically, the present invention provides a method and apparatus for repairing building foundations using interlocking segmented underpinning piles which are reinforced in a longitudinal direction.

In a preferred embodiment, the invention incorporates a precast starter segment with a coil embedded in one end of the segment, and a coil rod protruding from the other end. This starter segment is driven into the soil with its protruding rod end facing downwards. A second segment is next interlocked with the first by threading the second segment's rod end into the coil end of the starter segment. The second segment is screwed into the first until the two lock. The segmented underpinning piling is then further driven into the ground with the second segment.

The above procedure is repeated for third, fourth, and additional segments until sufficient load capacity and depth are obtained for the underpinning piling. The process ultimately creates an interlocked segmented underpinning piling reinforced in the longitudinal direction.

In a preferred embodiment, the method and apparatus of a preferred embodiment of the present invention provides a longitudinally aligned, interlocked, and longitudinally reinforced, segmented underpinning piling. The segmented underpinning piling can be installed with minimal clearance underneath an existing structure.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 19 shows two pile sections interlocked in a second alternative embodiment;

FIG. 20 shows an exploded view of a second alternative embodiment.

DETAILED DESCRIPTION OF THE INVENTION

Figure 2:
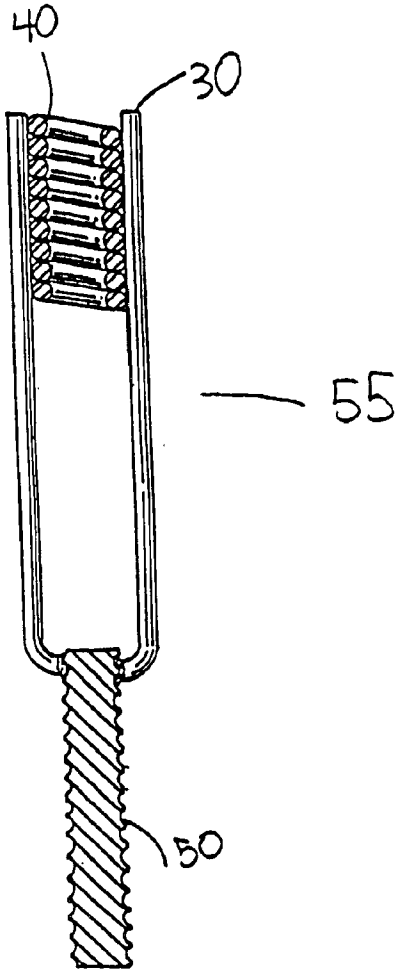
FIG. 2 is a section view of a upper coil, bars, and rod in a preferred embodiment of the apparatus of the present invention.
Figure 1:
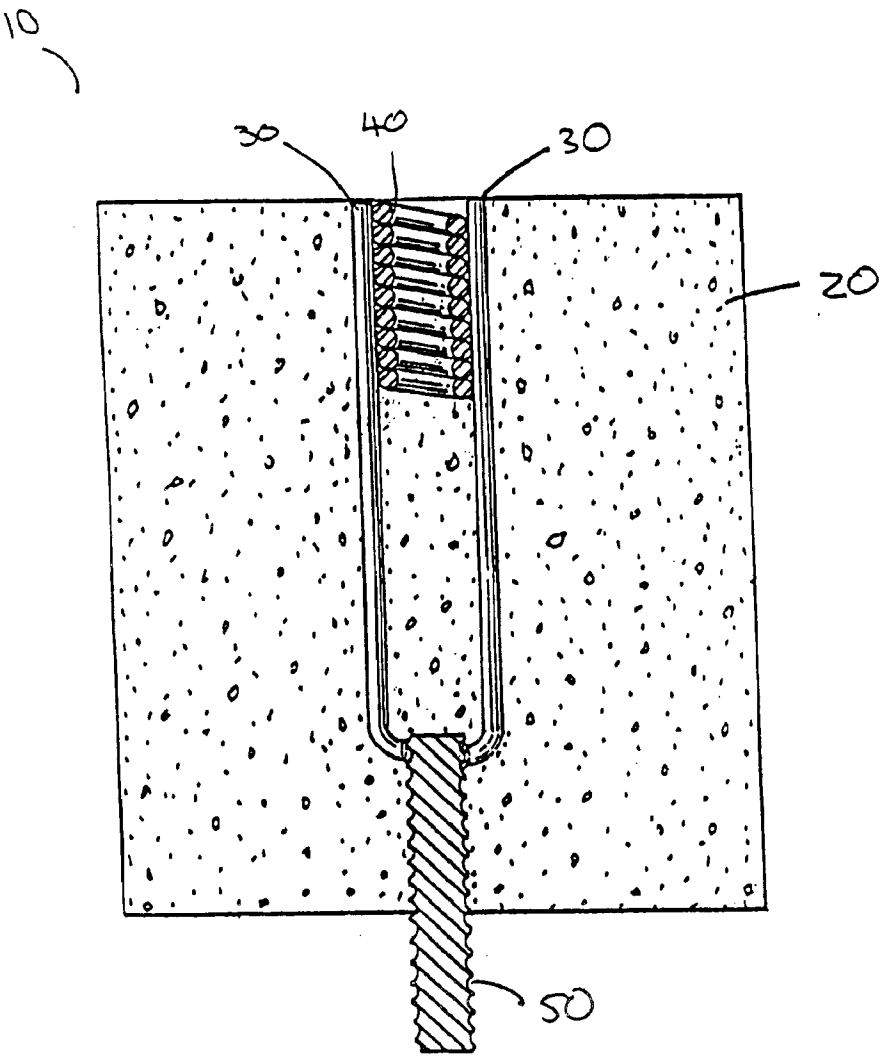
FIG. 1 is sectional view of a pile section in a preferred embodiment of the apparatus of the present invention.
Figure 10:
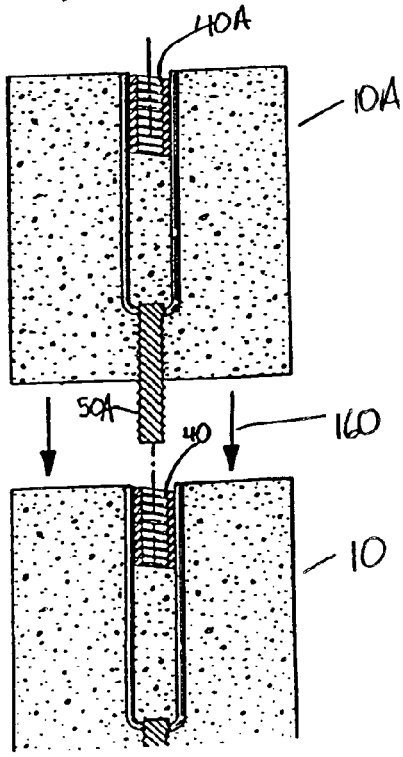
FIG. 10 shows a second pile segment being attached to the starter pile segment.

FIG. 1 is sectional view of a pile section 10 in a preferred embodiment of the apparatus of the present invention. The segment body 20 can be made of concrete or other structural material having good compressive strength. It preferably has a circular cross section of approximately 6 to 14 inches in diameter and is 6 to 14 inches in height. However, its cross-section can be of different or varying shapes without substantially impacting the effectiveness of each segment's bearing capacity. As shown in FIG. 2, the segment body 20 includes two bars 30, coil 40, and rod 50. The two bars 30 can be attached to the coil 40 and rod 50 by various conventionally means such as welding. The pitch of the threads for the coil 40 and rod 50 should match and should be course enough to avoid seizure even if particles of soil become lodged inside said threads. One thread which has worked is adapted (as shown in FIGS. 1, 2, and 10) from the coil rod, coil hangers, and/or screed chairs manufactured by Meadow Burke (www.meadowburke.com). The two bars 30, coil 40, and rod 50 form interlocking unit 55. Interlocking unit 55 can be prefabricated and then integrally cast with segment body 20. Preferably interlocking unit 55 is placed in the center of the cross section of segment body 20 along the body's longitudinal axis. Placing interlocking unit 55 in the center facilitates easy installation of various pile segments along a single longitudinal axis.

Figure 3:
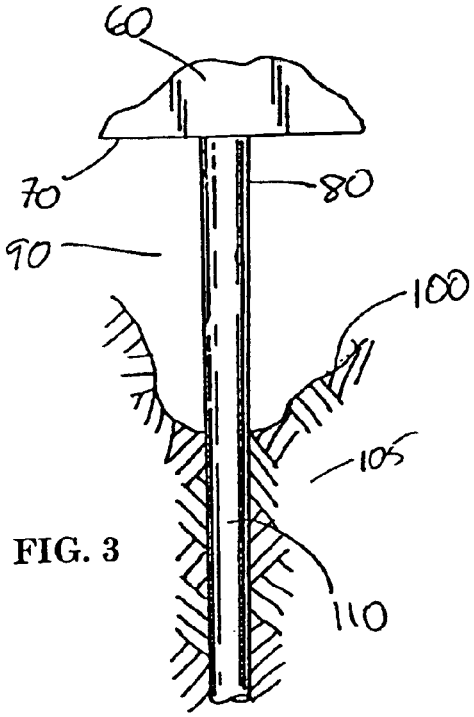
FIG. 3 shows an excavated area under a building slab which is supported by a wooden piling.
Figure 4:
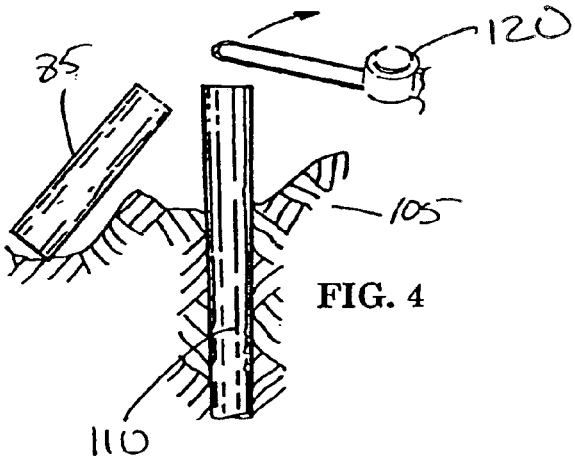
FIG. 4 shows the upper portion of the wooden piling being removed.
Figure 5:
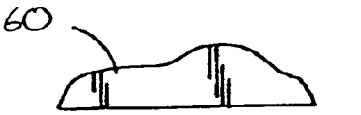
FIG. 5 shows the top of the lower portion of the wooden piling being drilled.
Figure 5:
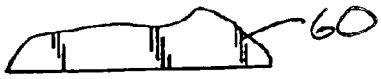
Figure 5:
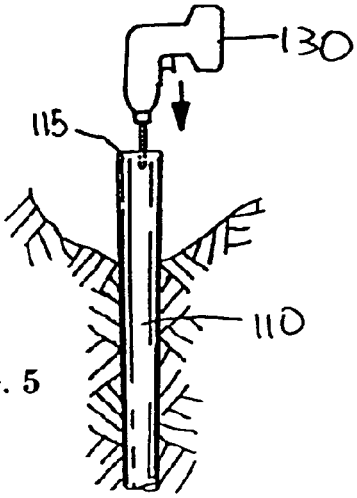

FIGS. 3 through 15 show various steps for installing a segmented piling on top of an existing wooden piling. As shown in FIG. 3 an excavated area 90 under the building slab 60 and around the upper portion 80 of the wooden piling is made. FIG. 4 shows the upper portion 80 of the wooden piling being removed by a saw 120. The lower portion 110 of the wooden piling remains in the subsoil 105. FIG. 5 shows the top 115 of the lower portion 110 of the wooden piling being drilled by drill 130 to form bore 116.

Figure 6:
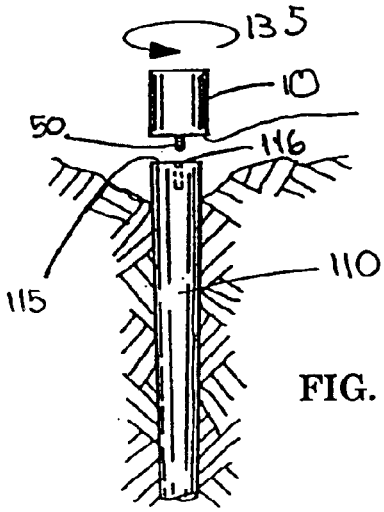
FIG. 6 shows a starter pile segment being attached to the top of the lower portion of the wooden piling.
Figure 7:
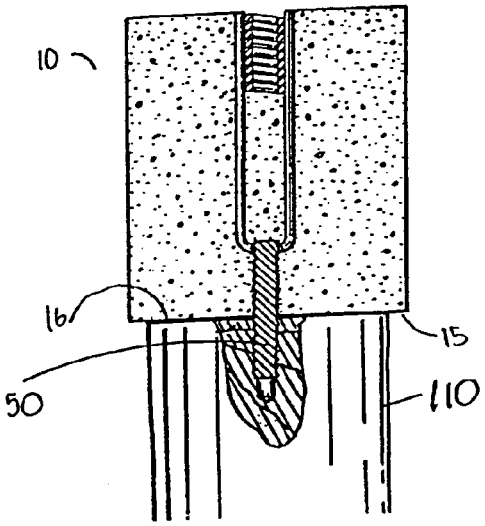
FIG. 7 is a sectional view of FIG. 6 showing the starter pile segment attached to the top of the lower portion of the wooden piling.

FIG. 6 shows a starter pile segment 10 being attached to the top 115 of the lower portion of the wooden piling. The starter pile segment 10 is turned in the direction of arrow 135 while downward pressured is placed. Rod 50 will threadably lock with the lower section 110 of wooden piling through bore 116. FIG. 7 is a sectional view of FIG. 6 showing the starter pile segment 10 attached to the top of lower portion 110 of the wooden piling. The threads of rod 50 are interlocked with the wooden piling and the bottom surface 15 of segment 10 is touching the top surface 16 of wooden piling. Thus, the segment 10 and wooden piling can become interlocked.

Figure 8:
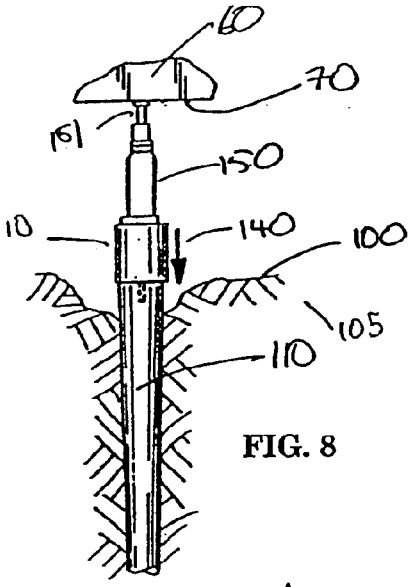
FIG. 8 shows a jack being used to push the starter pile segment and wooden piling into the soil.
Figure 9:
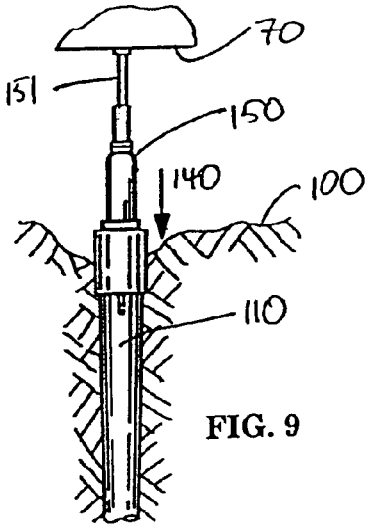
FIG. 9 shows the jack of FIG. 8 after the starter pile segment and wooden piling have been pushed down into the soil.

FIG. 8 shows jack 150 being used to push starter pile segment 10 and wooden piling into soil 105 in the direction of arrow 140. The downward pushing force is created by the weight of the building slab 60 as jack arm 151 is raised. FIG. 9 shows jack 120 having been pushed down into soil 105 (in the direction of arrow 140) both starter pile segment 10 and wooden piling where jack arm 151 is in a raised condition. Downward movement is achieved where the reactionary force from the building slab 60 transferred through jack arm 151 exceeds the combined frictional forces created by soil 105 against the lower portion 110 of the wooden piling. Jack 150 is now removed so that another segmented piling 10 can be installed.

Figure 15:
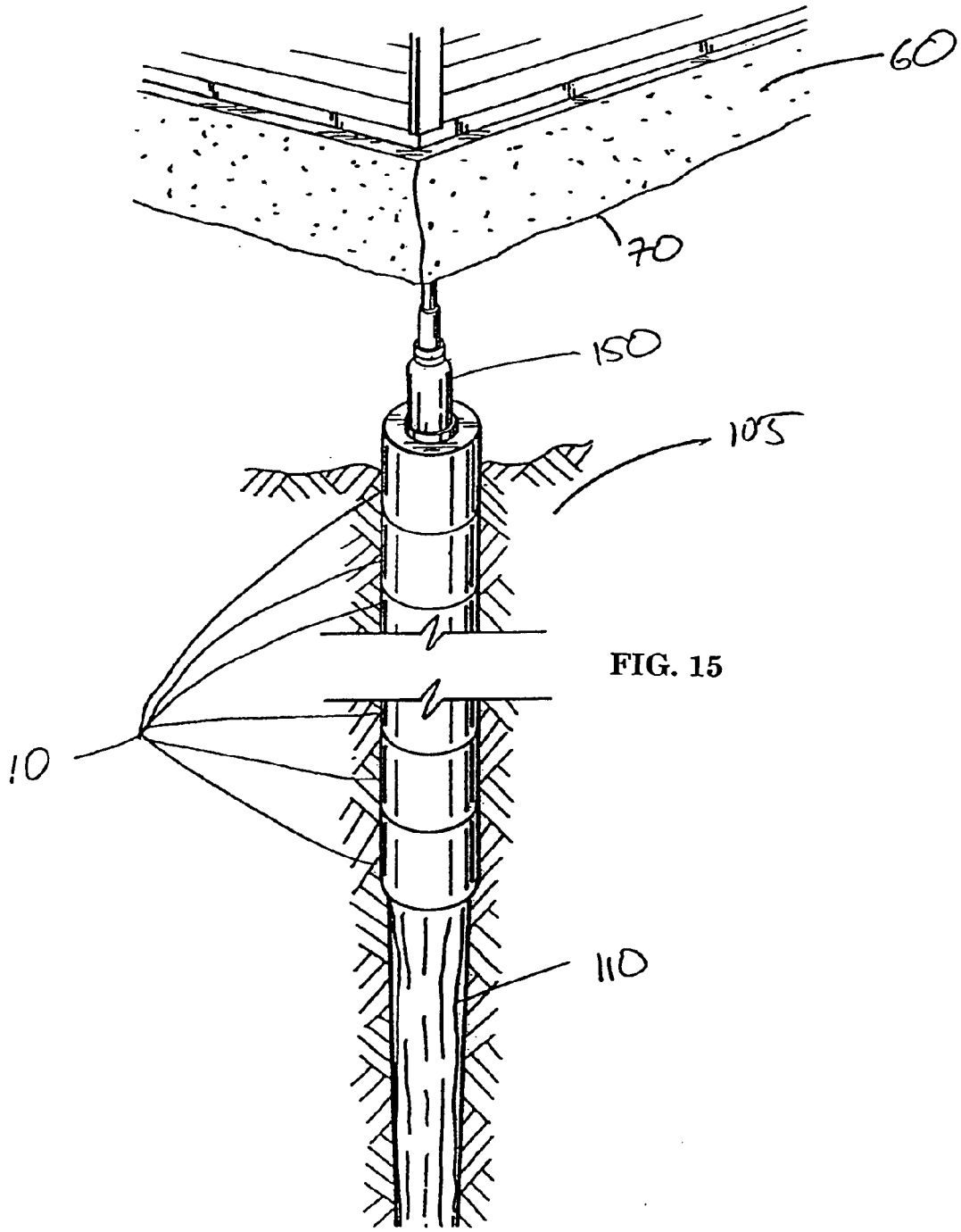
FIG. 15 shows a sectional and perspective view of a preferred embodiment of the apparatus of the present invention after several pile segments and the wooden piling have been pushed into the soil.

FIG. 10 shows a second pile segment 10A being attached to the starter pile segment 10. Rod 50A of pile segment 10A threadably engages coil 40 of pile segment 10. Pile segment 10A is turned until its lower surface engages the upper surface of pile segment 10. Thus, pile segment 10A and pile segment 10 become interlocked with each other. Jack 150 is placed on top of pile segment 10A and the previously described process of jacking and pushing down is repeated until pile segment 10A, pile segment 10, and wooden piling have been pushed down into soil 105 in the direction of arrow 140. Jack 150 is then again removed. FIG. 15 shows a perspective view of a preferred embodiment of the apparatus of the present invention after several pile segments 10 and the lower portion 110 of the wooden piling have been pushed into soil 105. Building slab 60 is supported by jack 150 which is supported on the uppermost pile segment 10.

Figure 11:
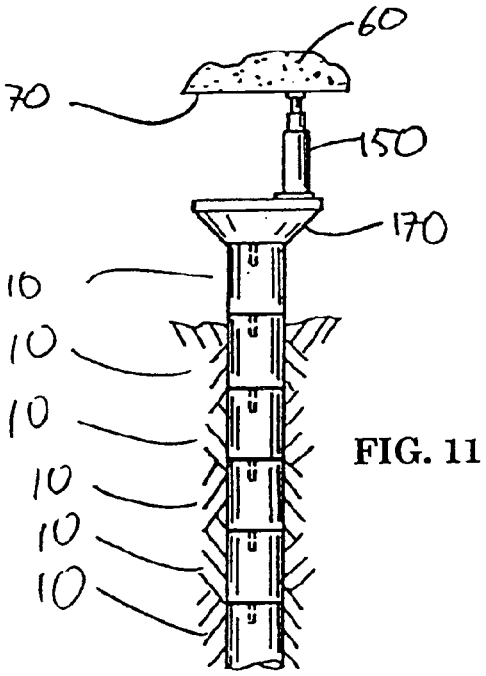
FIG. 11 shows the jack supporting the slab after several pile segments have been pushed into the soil.

Additional pile segments can be installed using similar procedures until the frictional forces from the soil 105 on the lower section 110 of the wooden piling until all segmented pile sections 10 reach a point where jack 150 can actually lift building slab 60 instead of further pushing down the segmented piling. Piling cap 170 is then installed on top of the uppermost segmented pile 10. This point is shown in FIG. 11 where jack 150 is supporting slab 60 after several pile segments 10 have been pushed into soil 105. The lower portion 110 of the wooden piling is below the numerous segmented pile sections 10.

Figure 12:
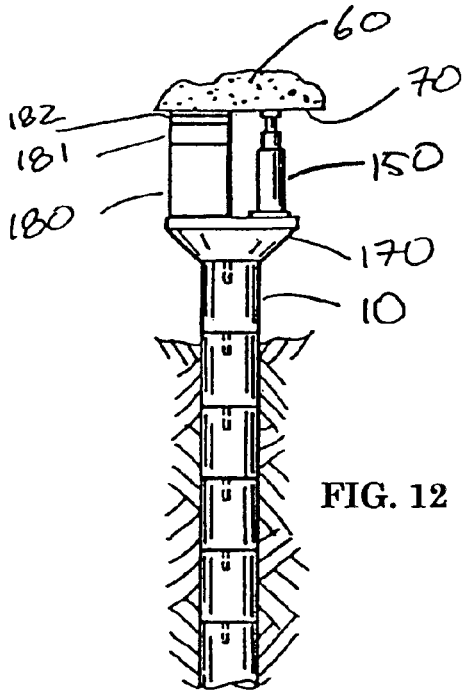
FIG. 12 shows a block being placed on top of the piling cap while thejack is supporting the building slab after several pile segments have been pushed into the soil.
Figure 13:
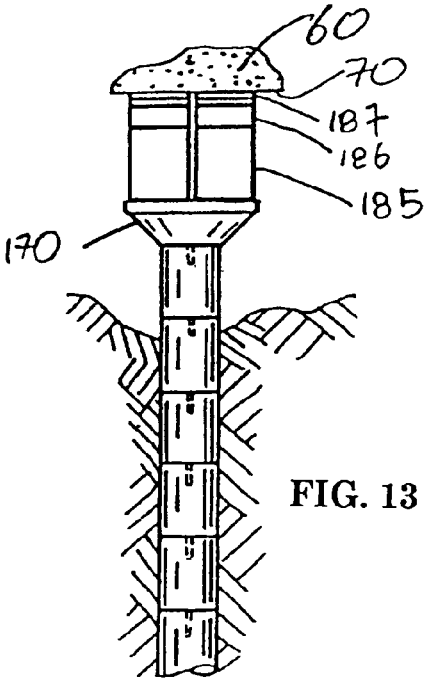
FIG. 13 shows two blocks supporting the building slab after several pile segments have been pushed into the soil.

FIG. 12 shows a block 180 and shims 181, 182 placed on top of piling cap 170 while the jack 150 is supporting the building slab 60 after several pile segments 10 have been pushed into the soil 105. Ultimately, building slab 60 will rest on block 180 and shims 181, 182. Shims 181, 182 should be selected to ensure proper height of the bottom 70 of building slab 60. FIG. 13 shows two blocks supporting building slab 60 after several pile segments 10 have been pushed into soil 105. A second block 185 and second set of shims 186, 187 are inserted between pile cap 170 and building slab 60.

Figure 14:
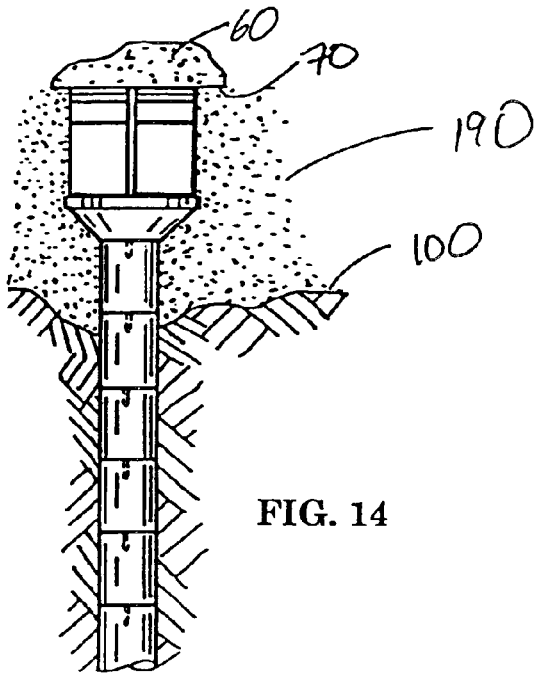
FIG. 14 shows backfill filling the excavated space under the slab.

FIG. 14 shows backfill 190 filling the excavated space 90 under building slab 60. The backfill 190 can be sand or other fill compatible with soil 105. Preferably, the backfill should be self-compacting to minimize possible subsidence.

The above described process has included a wooden piling. However, the segmented piling blocks 10 can be used by themselves without wooden pilings.

Figure 16:
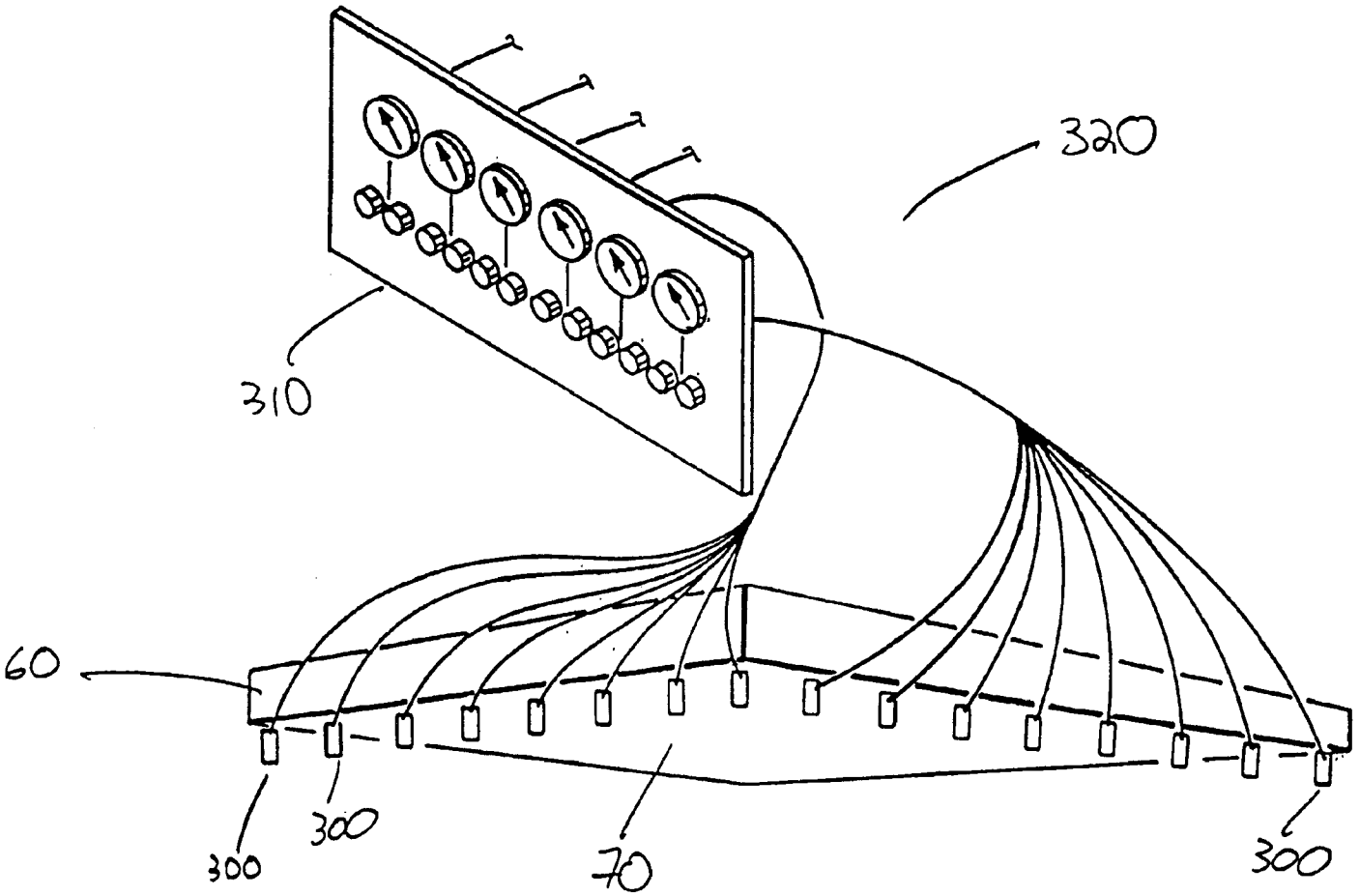
FIG. 16 shows a perspective view of a control system for simultaneously operating a series of hydraulic jacks for controlling the lift of a defined area of the building slab.

FIG. 16 shows a perspective view of a conventionally available control system 320 for simultaneously operating a series of hydraulic jacks 300 for controlling lift of a defined area of building slab 60. Use of control system 320 minimizes the risk that slab 60 will crack due to differential forces created by the set of jacks 300. Using individual jacks risks differentially raising the slab and creating stress cracks. Using control system 320 allows numerous segmented piles to be simultaneously pushed into soil 105.

Figure 17:
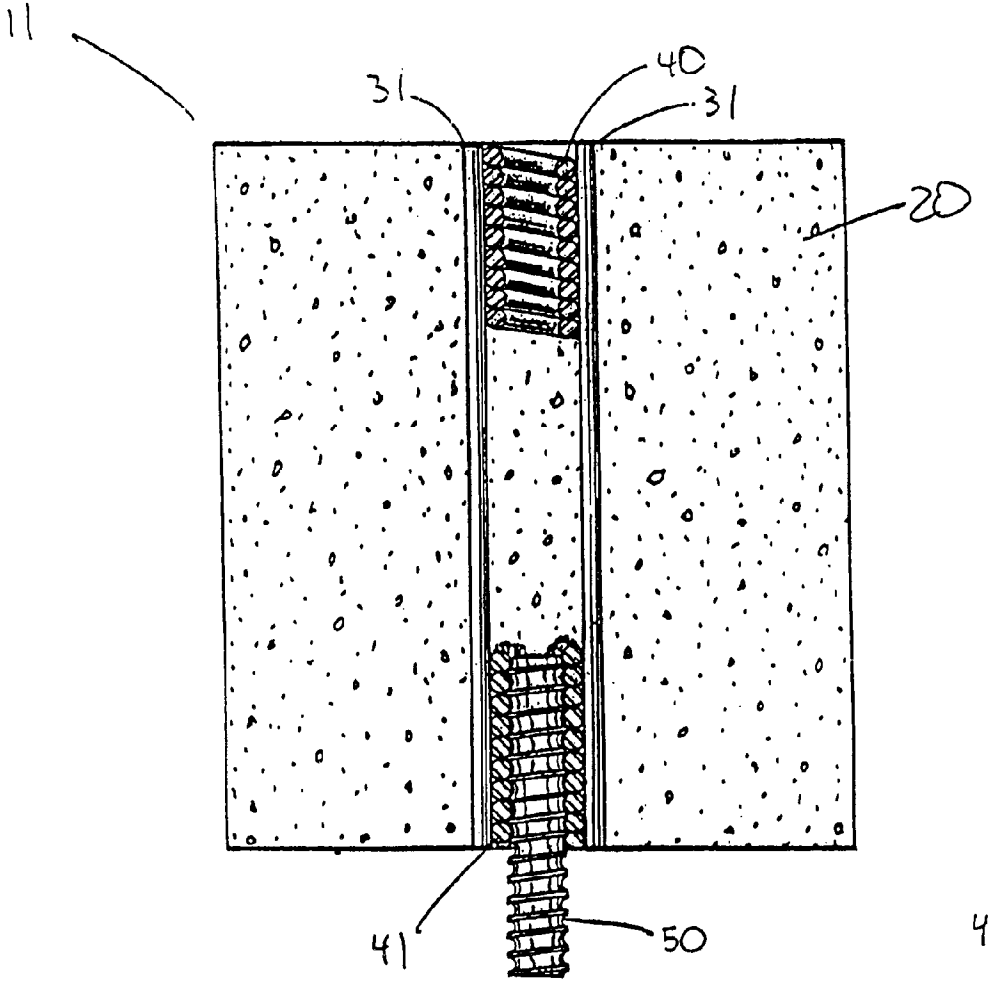
FIG. 17 is sectional view of an alternative embodiment for a pile section in a preferred embodiment of the apparatus of the present invention.

FIG. 17 is sectional view of an alternative embodiment for a pile section 11 in a preferred embodiment of the apparatus of the present invention. The segment body 20 can be made of concrete or other structural material having good compressive strength. It preferably has a circular cross section of approximately 6 to 14 inches in diameter and is 6 to 14 inches in height. However, its cross-section can be of different and varying shapes without substantially impacting the effectiveness of each segment's bearing capacity. The segment body 20 includes two bars 31 which substantially extend throughout the height of block 20. Also included are upper coil 40 and lower coil 41. Rod 50 is threadably attached by lower coil 41 and can be permanently welded or attached by some other conventional means.

Figure 18:
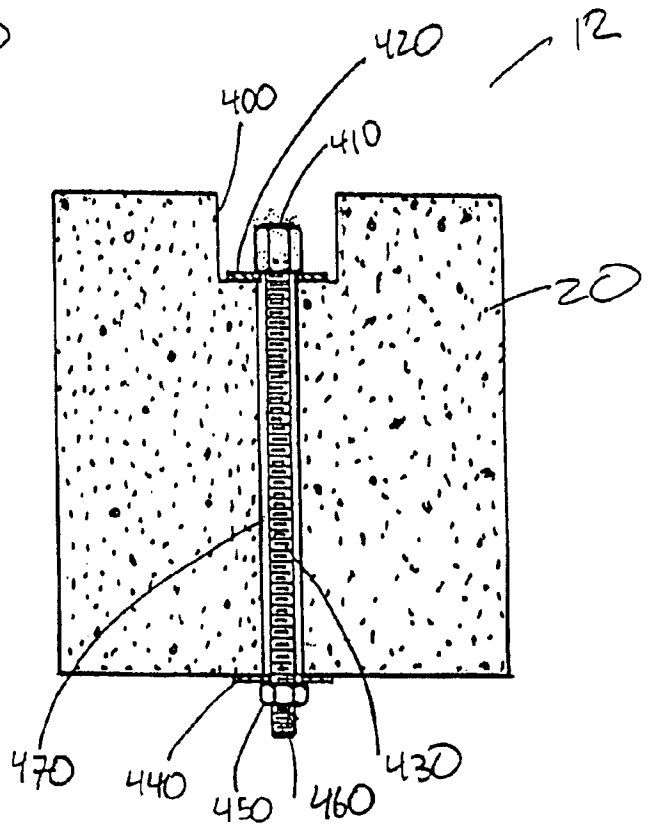
FIG. 18 is sectional view of a second alternative embodiment for a pile section in a preferred embodiment of the apparatus of the present invention.

FIGS. 18 and 20 show sectional views of a second alternative embodiment for a pile section 12 in a preferred embodiment of the apparatus of the present invention. The segment body 20 can be made of concrete or other structural material having good compressive strength. It preferably has a circular cross section of approximately 6 to 14 inches in diameter and is 6 to 14 inches in height. However, its cross-section can be of different and varying shapes without substantially impacting the effectiveness of each segment's bearing capacity. The segment body 20 includes a recessed space 400 and longitudinal bore 470. A threaded rod 430 is placed in longitudinal bore 470. Upper washer 420 is placed in recessed spaced 400 over threaded rod 430. Nut 410 is threaded onto the top portion of threaded rod 430 in recessed space 400. Lower washer 440 is placed over the lower portion of threaded rod 430 and nut 450 used to secure threaded rod 430 into block 20. Nut 410 is installed on rod 430 such that it has adequate threads above the top of rod 430 to accept a second rod. The bottom of rod 460 has adequate threads protruding through nut 450 so that it can threadably engage a nut 410 on a second block 12. Nuts 410 and 450 can be torqued down on block 20 to prevent rotational slippage of rod 430. FIG. 19 shows two pile sections 12 and 12A interlocked in a second alternative embodiment. The portion of rod 430A protruding through nut 450 threadably engages nut 410. Thus sections 12 and 12A become interlocked.

PARTS LIST

The following is a list of parts and materials suitable for use in the present invention:

Reference Numeral Description

10 pile segment of a preferred embodiment of the present invention
10A second pile segment
11 pile segment for an alternative embodiment
12 pile segment for a second alternative embodiment
12A second pile segment for second alternative embodiment
15 bottom surface of pile section
16 top surface of wooden piling
20 segment body (concrete or other structural material)
30 bar (steel, copper, aluminum or other structural material)
31 bar (steel, copper, aluminum or other structural material)
40 upper coil
40A upper coil in second pile segment
41 lower coil
50 rod
50A rod in second pile segment
55 interlocking unit
60 building slab
70 bottom of slab
80 upper portion of wood piling
85 cut portion of wood piling
90 excavated space under building slab
100 top of soil
105 soil
110 lower portion of wood piling
115 top portion
116 longitudinal bore
120 saw
130 drill
135 arrow
140 arrow
150 jack
151 raised portion of jack
160 arrows
170 pile cap
180 block
181 shim
182 small shim
185 block
186 shim
187 small shim
190 backfill
300 hydraulic jacks
310 control panel for hydraulic jacks
320 hydraulic lifting system

400 recessed space
410 upper nut
420 upper washer
430 rod
430A rod
440 lower washer
450 lower nut
450A lower nut
460 lower tip of rod
470 longitudinal space through pile segment All measurements disclosed herein are at standard temperature and pressure, at sea level on Earth, unless indicated otherwise. All materials used or intended to be used in a human being are biocompatible, unless indicated otherwise.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims.

The foregoing embodiments are presented by way of example only; the scope of the present invention is to be limited only by the following claims.

What is claimed is:

1. A process of leveling a structure by installing interlocked segmented underpinning piles for supporting the structure upon the earth comprising the steps of:

(a) driving a first concrete pile segment into unexcavated earth a desired distance from the structure, the first pile segment comprising:
  (i) upper and lower substantially flat surfaces, and a first central axis of rotation;
  (ii) a first connector embedded in the first pile segment, positioned along the first central axis of rotation, the first connector having a coil;

(b) interlocking a second concrete pile segment with the first pile segment, the second pile segment comprising:
  (i) upper and lower substantially flat surfaces, and a second central axis of rotation;
  (ii) a second connector embedded in the second pile segment, positioned along the second central axis of rotation, and extending at least from the second pile segment's upper surface to the lower surface, the second connector having a coil, a rod, and a plurality of bars, the plurality of bars connecting the coil and the rod;

(c) wherein during step "b" the second connector engages the first connector by rotating the second pile segment around the second central axis of rotation until the lower surface of the second pile segment contacts the upper surface of the first pile segment; and (d) driving the second pile segment a desired distance into the earth.

2. The process of claim 1, further comprising the steps of:

(e) interlocking a third concrete pile segment with the second pile segment, the third pile segment comprising:
  (i) upper and lower substantially flat surfaces, and a third central axis of rotation;
  (ii) a third connector embedded in the third pile segment, positioned along the third central axis of rotation, and extending at least from the third pile segment's upper surface to the lower surface, the third connector having a coil, a rod, and a plurality of bars, the plurality of bars connecting the coil and the rod;

(f) wherein during "e" the third connector engages the second connector by rotating the third pile segment around the third central axis of rotation until the lower surface of the third pile segment engages contacts the upper surface of the second pile segment; and (g) driving the third pile segment a desired distance into the earth.

3. The process of claim 1, further comprising the steps of:

(f) positioning a cap member between the structure and the second pile segment; and (g) affixing a support member on a side of the cap member opposite the pile segments, the support member for abutment with the structure.

4. The process of claim 1, further comprising the steps of:

(f) removing a volume of earth from beneath a portion of the structure;

(g) positioning said first pile segment below the portion of the structure; and (h) placing a jack between the first pile segment and the portion of the structure.

5. The process of claim 1, wherein the first pile segment has a circular cross section between about 6 and 14 inches.

6. The process of claim 1, wherein the coil of the first connector and the rod of the second connector have course threads.

7. The process of claim 1, wherein the rod of the second connector is threadably engaged within the coil of the first connector.

8. The process of claim 1, further comprising the steps of:

(f) removing a volume of earth from beneath a portion of the structure and exposing a portion of a wooden piling;

(g) removing an upper section of the wood piling;

(h) positioning the first pile segment on top of a lower section of the wood piling; and (i) placing a jack between the first pile segment and the portion of the structure.

9. The process of claim 8, wherein the first connector further comprises a rod being positioned along the first central axis of rotation, the rod of the first connector further threadably engaging the wooden piling.

10. A process of leveling a structure by installing interlocked segmented underpinning piles for supporting the structure upon the earth comprising the steps of:

(a) driving a first concrete pile segment into unexcavated earth a desired distance from the structure, the first pile segment comprising:
  (i) upper and lower substantially fat surfaces, and a first central axis of rotation;
  (ii) a first connector embedded in the first pile segment, positioned along the first central axis of rotation, the first connector having a rod extending from the upper surface of the first pile segment;

(b) interlocking a second concrete pile segment with the first pile segment, the second pile segment comprising:
  (i) upper and lower substantially flat surfaces, and a second central axis of rotation;
  (ii) a second connector embedded in the second pile segment, positioned along the second central axis of rotation, and extending at least from the second pile segment's upper surface to the lower surface, the second connector having a coil, and a rod, and a plurality of bars, the plurality of bars connecting the coil and the rod;

(c) wherein during step "b" the second connector engages the first connector by rotating the second pile segment around the second central axis of rotation until the lower surface of the second pile segment engages contacts the upper surface of the first pile segment; and (d) driving the second pile segment a desired distance into the earth.

11. The process of claim 10, further comprising the steps of:

(e) interlocking a third concrete pile segment with the second pile segment, the third pile segment comprising:

(i) upper and lower substantially flat surfaces, and a third central axis of rotation;

(ii) a third connector embedded in the third pile segment, positioned along the third central axis of rotation, and extending at least from the third pile segment's upper surface to the lower surface, the third connector having a coil, and a rod, and a plurality of bars, the plurality of bars connecting the coil and the rod;

(f) wherein during step "e" the third connector engages the second connector by rotating the third pile segment around the third central axis of rotation until the lower surface of the third pile segment engages contacts the upper surface of the second pile segment; and (g) driving the third pile segment a desired distance into the earth.

12. The process of claim 10, further comprising the steps of:

(f) positioning a cap member between the structure and the second pile segment; and (g) affixing a support member on a side of the cap member opposite the pile segments, the support member for abutment with the structure.

13. The process of claim 10, further comprising the steps of:

(f) removing a volume of earth from beneath a portion of the structure;

(g) positioning said first pile segment below the portion of the structure; and (h) placing a jack between the first pile segment and the portion of the structure.

14. The process of claim 10, wherein the first pile segment has a circular cross section between about 6 and 14 inches.

15. The process of claim 10, wherein the rod of the first connector and the coil of the second connector have course threads.

16. The process of claim 10, wherein the rod of the first connector is threadably engaged with the coil of the second connector.

17. The process of claim 10, further comprising the steps of:

(f) removing a volume of earth from beneath a portion of the structure and exposing a portion of a wooden piling;

(g) removing an upper section of the wood piling;

(h) positioning the first pile segment on top of a lower section of the wood piling; and (i) placing a jack between the first pile segment and the portion of the structure.

18. The process of claim 17, wherein the first connector further comprises a second rod being positioned along the first central axis of rotation and threadably engages the wooden piling.

* * * * *